US008795097B2

(12) United States Patent
Chapman et al.

(10) Patent No.: US 8,795,097 B2
(45) Date of Patent: Aug. 5, 2014

(54) COMBINATION INFANT ROCKER AND SWING

(75) Inventors: Linda J. Chapman, Corfu, NY (US); Philip R. Pyrce, Getzville, NY (US)

(73) Assignee: Mattel, Inc., El Segundo, CA (US)

( * ) Notice: Subject to any disclaimer, the term of this patent is extended or adjusted under 35 U.S.C. 154(b) by 213 days.

(21) Appl. No.: 13/253,320

(22) Filed: Oct. 5, 2011

(65) Prior Publication Data

US 2012/0277013 A1 Nov. 1, 2012

Related U.S. Application Data

(60) Provisional application No. 61/390,897, filed on Oct. 7, 2010.

(51) Int. Cl.
*A63G 9/10* (2006.01)
*A63G 9/00* (2006.01)

(52) U.S. Cl.
USPC ..... 472/119

(58) Field of Classification Search
USPC ..... 472/118–125; 297/273, 281, 280, 277, 297/310, 364, 365; 5/108–109
See application file for complete search history.

(56) References Cited

U.S. PATENT DOCUMENTS

| | | | | |
|---|---|---|---|---|
| 3,256,016 | A | 6/1966 | Berlin | |
| 3,653,080 | A | 4/1972 | Hafele | |
| 4,150,820 | A | 4/1979 | Bochmann | |
| 4,324,432 | A | 4/1982 | Eldon, III et al. | |
| 4,616,824 | A | 10/1986 | Quinlan, Jr. et al. | |
| 4,688,850 | A | 8/1987 | Brownlie et al. | |
| 4,697,845 | A | 10/1987 | Kamman | |
| 4,985,949 | A | 1/1991 | Jantz | |
| 4,987,624 | A | 1/1991 | Nafti | |
| 5,342,113 | A | 8/1994 | Wu | |
| 5,368,361 | A | 11/1994 | Wen-Ming | |
| 5,378,196 | A | 1/1995 | Pinch | |
| 5,860,698 | A | 1/1999 | Asenstorfer et al. | |
| 6,068,566 | A | 5/2000 | Kim | |
| 6,386,986 | B1 | 5/2002 | Sonner et al. | |
| 6,872,146 | B1 | 3/2005 | Paesang et al. | |
| 7,422,524 | B2 * | 9/2008 | Gregorian | 472/119 |
| 7,445,560 | B2 | 11/2008 | Greger et al. | |
| 2006/0194639 | A1 | 8/2006 | Gregger | |
| 2006/0214486 | A1 | 9/2006 | Ransil | |
| 2007/0060405 | A1 | 3/2007 | Grossman et al. | |

FOREIGN PATENT DOCUMENTS

| | | | |
|---|---|---|---|
| EP | 1360917 | A1 | 11/2003 |

OTHER PUBLICATIONS

International Search Report for PCT/US2011/055053, May 18, 2012.

* cited by examiner

*Primary Examiner* — Kien Nguyen
(74) *Attorney, Agent, or Firm* — Edell, Shapiro & Finnan, LLC

(57) ABSTRACT

An infant support structure includes a seat assembly having a handle extending upwardly from a receiving area. The handle includes an engagement member. A support frame includes a lower portion configured for engaging a supporting surface and an upper portion. A mounting portion is coupled to the upper portion of the frame. The engagement member is removably and pivotally coupleable to the mounting portion. A drive mechanism is coupled to the mounting portion, and includes a ram reciprocally movable relative to the mounting portion. The ram is engageable with the handle so that the seat assembly swings back and forth relative to the support frame.

20 Claims, 19 Drawing Sheets

G

COMBINATION INFANT ROCKER AND SWING

CROSS-REFERENCE TO RELATED APPLICATIONS

This application claims the benefit of and priority under 35 U.S.C. 119(e) to U.S. Provisional Application No. 61/390,897, entitled "Combination Infant Rocker and Swing", filed Oct. 7, 2010, the disclosure of which is incorporated herein by reference in its entirety.

FIELD OF THE INVENTION

The present invention relates to an infant support structure, and in particular an infant support structure that may be reconfigured between a rocker mode and a swing mode.

BACKGROUND OF THE INVENTION

Various infant support structures for supporting an infant or child above a support surface are known, such as swings and rocker seats. Such support structures provide an enjoyable and safe area for a child or infant. Further, such support structures provide differing movements for the child. At certain times, it is more desirable for the parent or care giver, as well as the child, to be in a swing type structure, while at other times, it is more desirable for the child to be in a rocker type structure. As a result, parents and care givers often utilize various types of such support structures. However, obtaining and maintaining a variety of support structures may be expensive and cumbersome, given they are often expensive and bulky.

Therefore, there is a need for an infant support structure that may be utilized in either a rocker mode or a swing mode of operation. Further, there is a need for a combination rocker and swing support structure that is efficient and easy to operate.

SUMMARY OF THE INVENTION

The present invention is directed to a combination infant rocker and swing. The infant rocker includes a rocker frame having a curved lower portion and an upper portion. A seat portion is coupled to the upper portion, and a handle portion extends upwardly from the seat portion. A swing frame includes a lower portion configured for engaging a supporting surface and an upper portion. A mounting portion is coupled to the upper portion of the swing frame. The handle of the infant rocker is releasably and pivotally coupleable to the mounting portion of the swing frame. A drive mechanism is coupled to the mounting portion. The drive mechanism includes a drive member or ram reciprocally movable and engageable with the handle so that the seat portion swings back and forth relative to the swing frame.

In one embodiment, the mounting portion includes a locking mechanism configured to releasably lock the handle to the mounting portion. In one implementation, the locking mechanism includes a lever and a release actuator configured to move the lever between a locked position and an unlocked position.

In one embodiment, the handle includes an engagement bar receivable in a correspondingly configured recess disposed in the mounting portion. In one implementation, the engagement bar includes a rod with bearings coupled thereto. The rod defines a rotational axis about which the seat portion swings.

In one embodiment, the handle includes an engagement portion receivable in a correspondingly configured recess disposed in the mounting portion. A side portion extends between the engagement portion and the seat portion. In one implementation, the ram is offset from the recess of the mounting portion, and engageable with the side portion of the handle. The ram is linearly movable along a direction which imparts a horizontal force component to the side portion of the handle relative to the support surface.

The present invention is also directed to an infant support structure including a seat assembly defining a receiving area configured for supporting an infant therein. A handle is coupled to the seat assembly and extends upwardly from the receiving area. The handle includes an engagement member. A swing support frame includes a lower portion configured for engaging a supporting surface and an upper portion. A mounting portion is coupled to the upper portion of the support frame. The engagement member is removably and pivotally coupleable to the mounting portion. A drive mechanism is coupled to the mounting portion. The drive mechanism includes a ram reciprocally movable relative to the mounting portion. The ram is engageable with the handle so that the seat assembly swings back and forth relative to the swing support frame.

In one embodiment, the seat assembly includes a frame having a curved lower portion configured for rocking back and forth on the supporting surface when the seat assembly is decoupled from the mounting portion.

In one embodiment, the handle includes a side portion extending between the engagement member and a side portion of the seat assembly.

In one embodiment, the engagement member includes at least one bearing receivable in a correspondingly configured recess disposed in the mounting portion.

In one embodiment, the mounting portion includes a recess configured to receive the engagement member. In one implementation, the mounting portion includes a slide member movable between a first position blocking an opening of the recess so that the engagement member is secured therein, and a second position allowing access to the opening of the recess so that the engagement member may be removed from therefrom.

In one embodiment, the receiving area has a longitudinal axis. The ram is linearly movable along an axis offset from the longitudinal axis of the receiving area.

In one embodiment, the drive mechanism includes a position detecting mechanism. The position detecting mechanism is configured to detect a position of the ram relative to the mounting portion.

The present invention is also directed to a drive mechanism for a swing. The drive mechanism includes a mounting portion defining a recess configured for releasably receiving a first portion of a handle of a seat assembly. A ram is reciprocally movable relative to the mounting portion and offset from the recess. The ram is configured for engaging a second portion of the handle of the seat assembly.

In one embodiment, the drive mechanism also includes a slide member coupled to the mounting portion. The slide member is movable between a first position blocking an opening of the recess and a second position allowing access to the opening of the recess.

In one embodiment, the mounting portion includes engagement sockets configured for receiving correspondingly configured portions of a support frame for the swing.

The mounting portion is substantially centered over a receiving area for the swing when coupled to the support frame.

BRIEF DESCRIPTION OF THE DRAWINGS

Like reference numerals have been used to identify like elements throughout this disclosure.

DETAILED DESCRIPTION OF THE INVENTION

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

The terms "infant support structure" and "support structure" may be used interchangeably herein.

Figure 1:
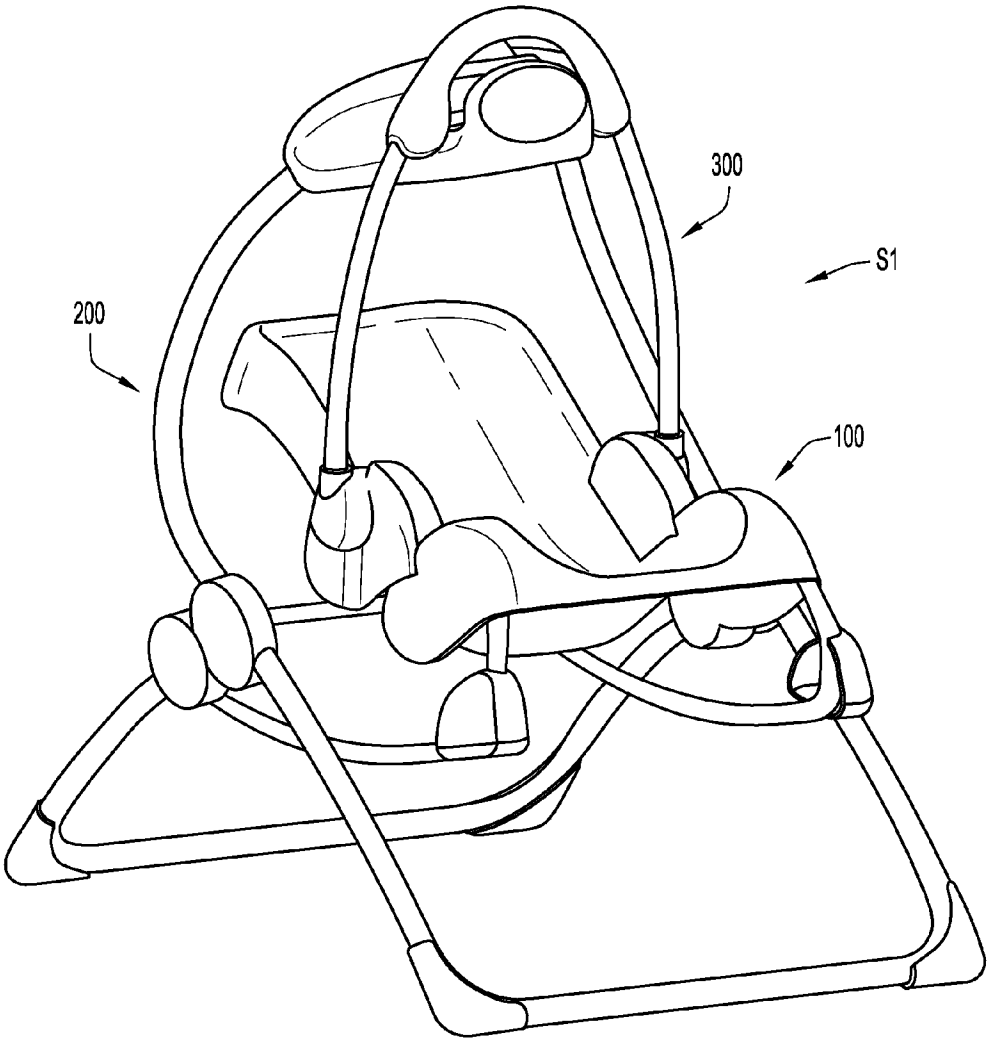
FIG. 1 illustrates a front perspective view of a combination infant rocker and swing apparatus according to an embodiment of the present invention.
Figure 2:
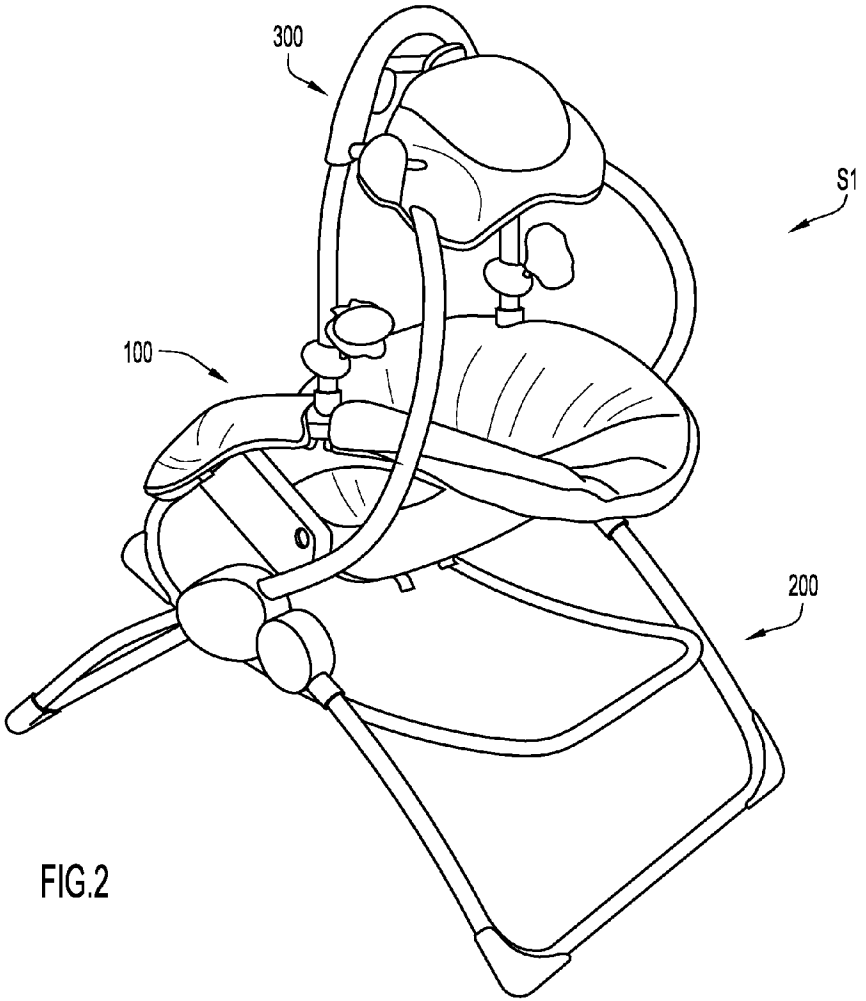
FIG. 2 illustrates a rear perspective view of the apparatus of FIG. 1.
Figure 3:
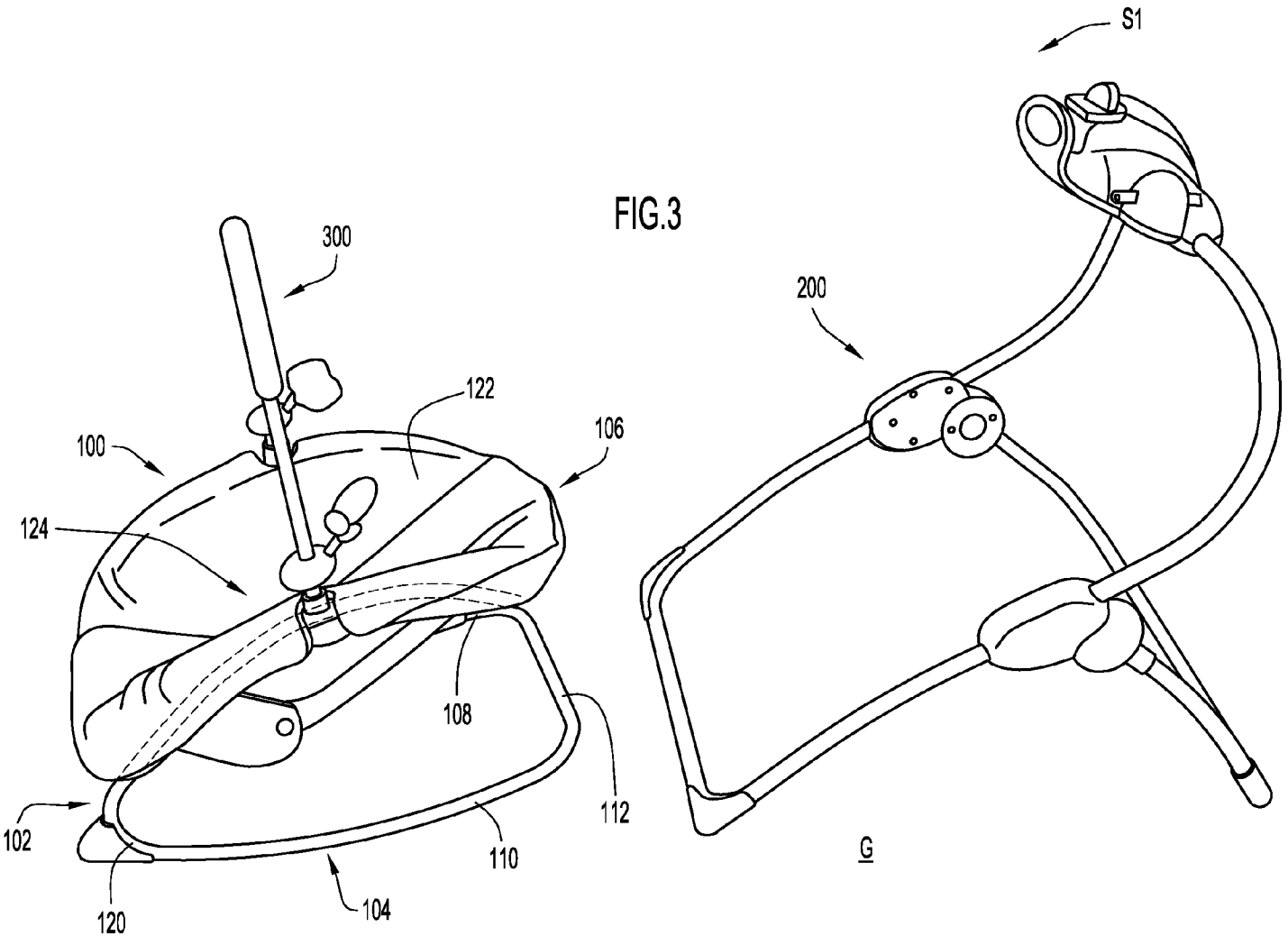
FIG. 3 illustrates a perspective view of the apparatus of FIG. 1 showing the rocker decoupled from the swing support.

FIGS. 1 and 2 illustrate a combination infant rocker and swing S1 according to an embodiment of the present invention. The combination rocker and swing S1 includes an infant rocker 100 and a swing support 200. Referring to FIG. 3, the infant rocker 100 is releasably coupleable to the swing support 200. Thus, the infant rocker 100 functions as a stand alone rocker (as shown in FIG. 3), or may be coupled to the swing support 200 and function as a seat portion of a swing (as shown in FIGS. 1 and 2) for a head-to-toe swinging mode of operation.

Figure 4:
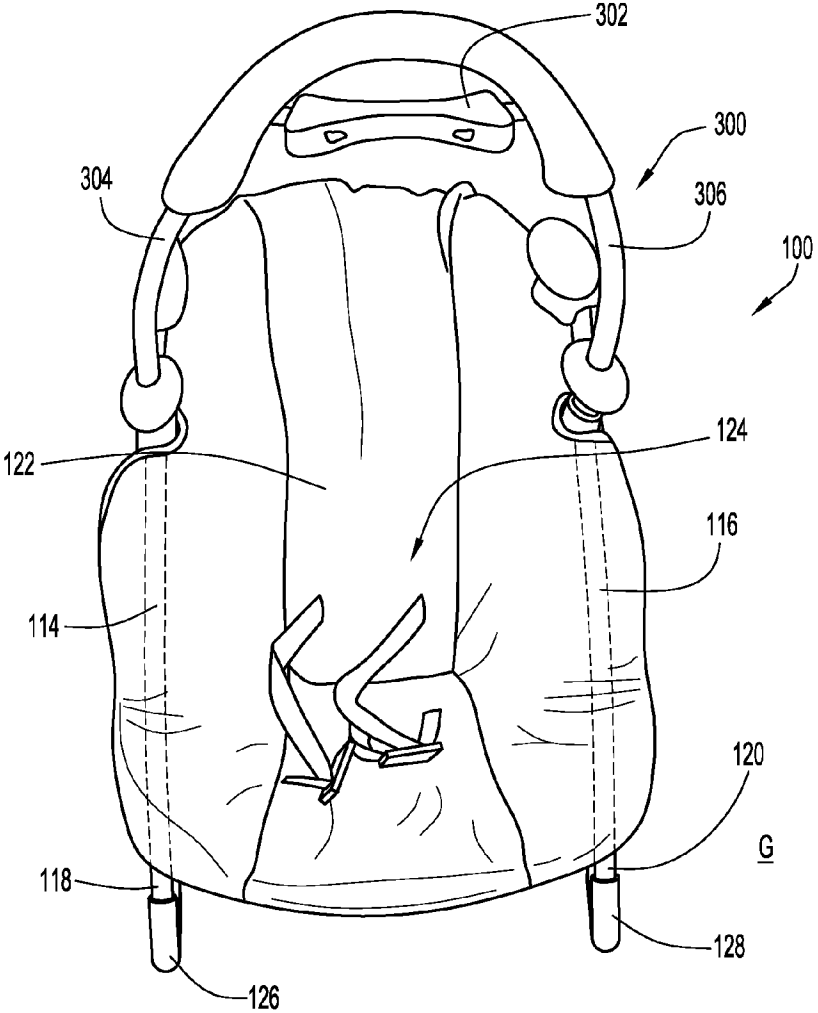
FIG. 4 illustrates a front perspective view of the infant rocker of FIG. 3.

Referring to FIGS. 3 and 4, the infant rocker 100 includes a rocker frame 102 having a lower portion 104 and an upper portion 106. In one embodiment, the lower portion 104 includes arcuate left and right base members 108, 110, which are configured to rockingly engage a supporting surface G. A rear support member 112 may extend between rear portions of the left and right base members 108, 110. In one implementation, the left and right base members 108, 110 and the rear support member 112 are integrally formed, such as from tubular metal, and collectively have a generally U-shaped configuration.

The upper portion 106 of the frame 102 has arcuate left and right side members 114, 116 (shown in part in phantom) extending upwardly from front end portions 118, 120 of the left and right base members 108, 110, respectively. A seat 122 is coupled to and disposed between the left and right side members 114, 116. The seat 122 defines a receiving area 124 configured for supporting a child or infant therein. The seat 122 may be at least partially defined by or include a liner formed from a flexible and/or soft material disposed within the receiving area 124.

The curved configuration of the lower portion 104 of the rocker frame 102 permits rocking back and forth motion when the infant rocker 100 is decoupled from the swing support 200. Left and right stops 126, 128 may be coupled to the front end portions 118, 120 of the left and right base members 108, 110 to limit the range of rocking motion of the infant rocker 100.

With continued reference to FIG. 4, a handle 300 is coupled to the seat 122, and extends upwardly from the receiving area 124. The handle 300 includes an engagement member 302, a left side portion 304, and a right side portion 306. In one implementation, the engagement member 302 is disposed above the receiving area 124 and generally centered between the left and right side members 114, 116 of the rocker frame 102. The left side portion 304 of the handle 300 extends between and interconnects the left side member 114 of the frame 102 and the engagement member 302. The right side portion 306 extends between and interconnects the right side member 116 of the frame 102 and the engagement member 302.

Figure 5:
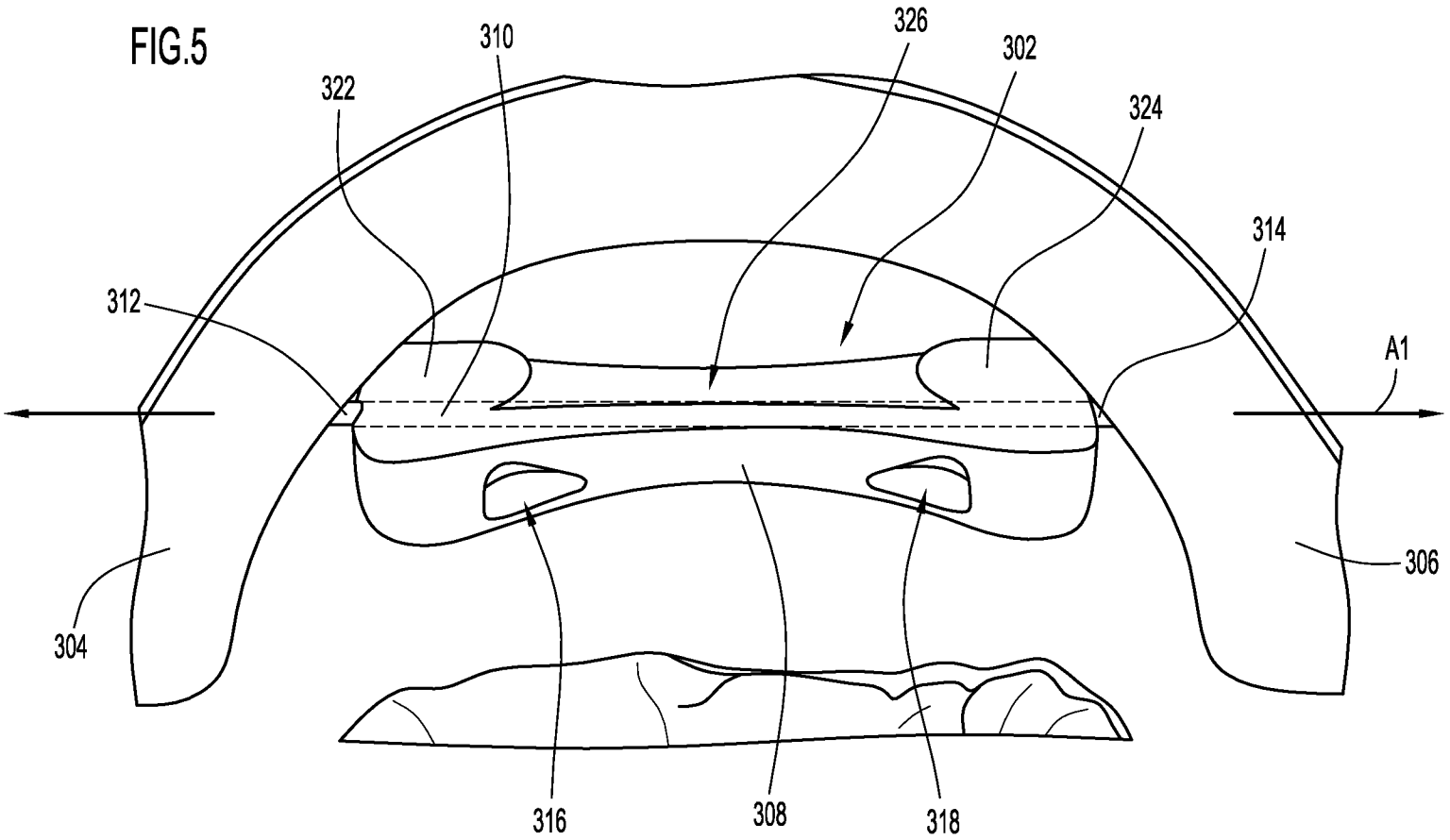
FIG. 5 illustrates a perspective fragmentary view of the infant rocker of FIG. 4 showing a close-up view of the engagement member.

Referring to FIG. 5, the engagement member 302 has a generally elongate body 308 extending between the left side portion 304 and the right side portion 306 of the handle 300. In one implementation, a rod 310 or bar extends through the body 308 (as shown in phantom). Opposing ends 312, 314 of the rod 310 are connected to the left and right side portions 304, 306, respectively. The body 308 is rotatably disposed on the bar 310, which defines a rotational axis A1 about which the seat 122 swings. The rod 310 and thus the left and right side portions 304, 306 of the handle 300 as well as the seat 122 are pivotal about the axis A1 and relative to the body 308.

The body 308 of the engagement member 302 may include indents 316, 318, which engage and receive corresponding configured protrusions on the mounting portion of the swing support (described in further detail below). Further, the body 308 may include raised end portions 324, 322 disposed along an upper surface 326 thereof. The raised end portions 324, 322 cooperate with a locking mechanism configured to releasably secure the engagement member 302, and thus the handle 300 and the seat 122, to the mounting portion of the swing support 200 (described in further detail below).

Figure 6:
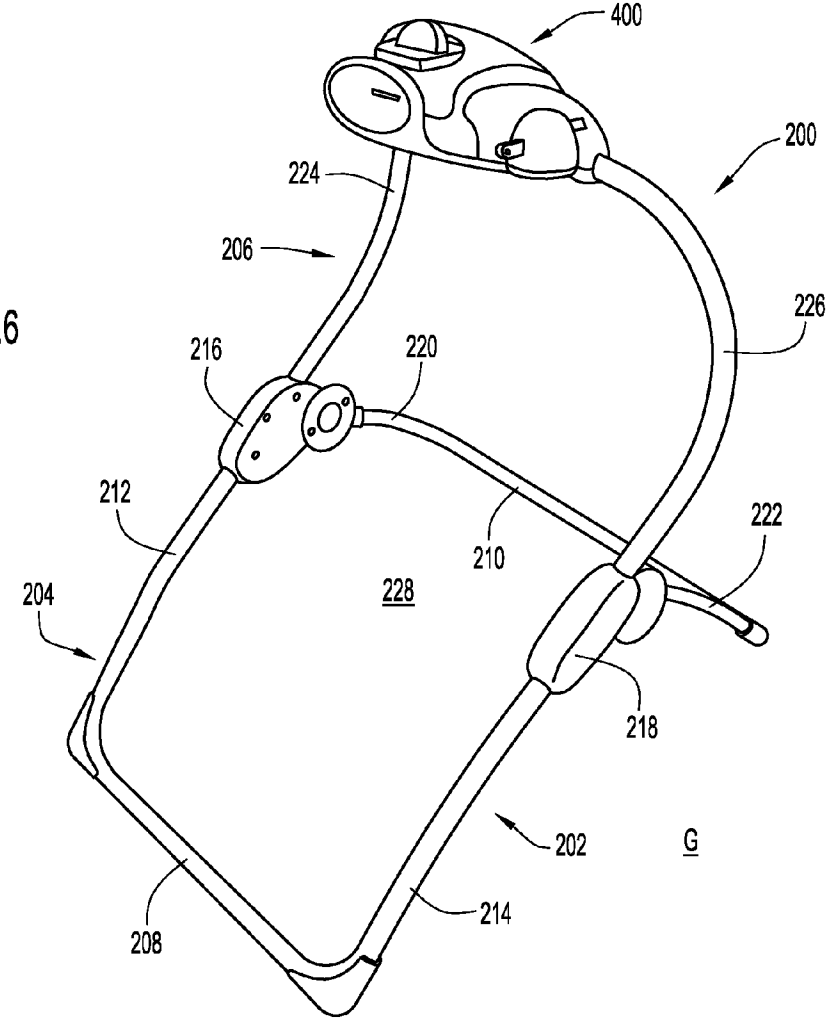
FIG. 6 illustrates a front perspective view of the swing support of FIG. 3.
Figure 7:
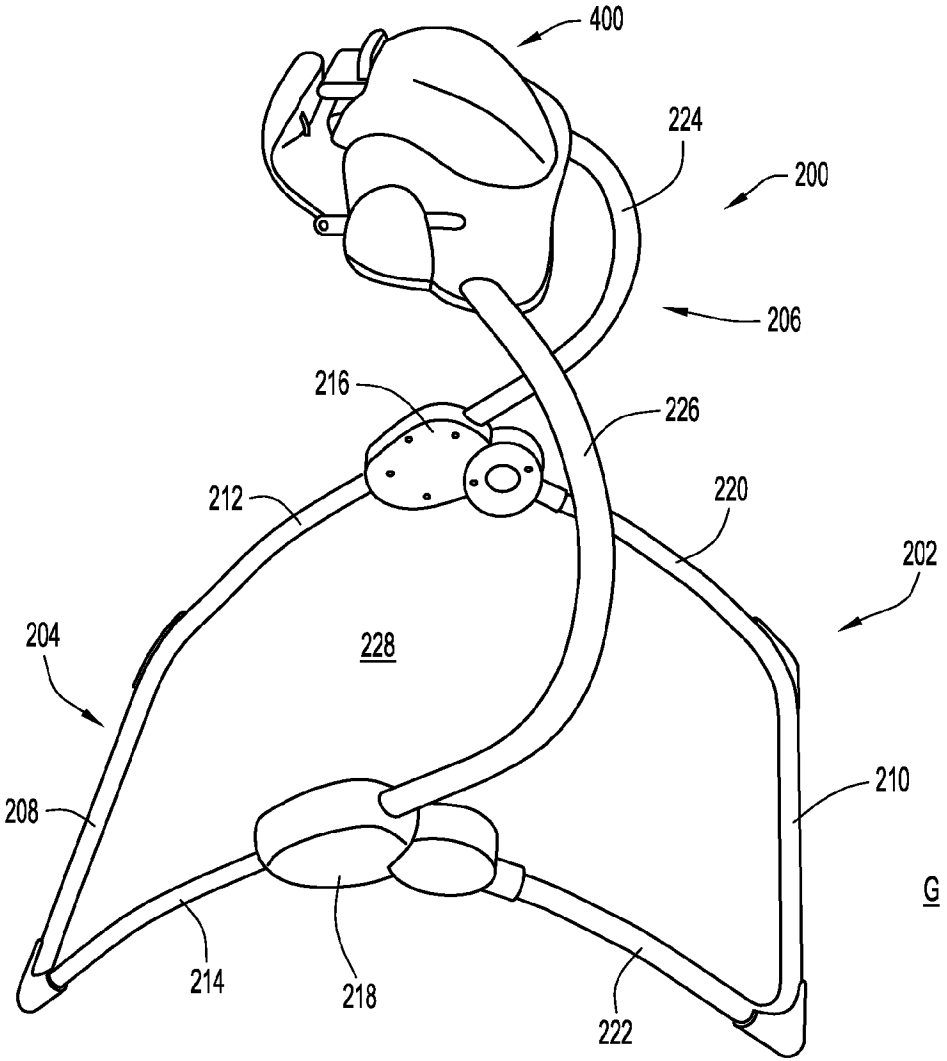
FIG. 7 illustrates a side perspective view of the swing support of FIG. 3.

Referring to FIGS. 6 and 7, the swing support 200 includes a swing frame 202 including a lower portion 204 configured for engaging the supporting surface G and an upper portion 206. The lower portion 204 includes a front member 208 and a rear member 210. Left and right front side members 212, 214 extend upwardly from opposing ends of the front member 208, and are coupled to left and right hubs 216, 218, respectively. Similarly, left and right rear side members 220, 222 extend upwardly from opposing ends of the rear member 210, and are coupled to the left and right hubs 216, 218, respectively.

The upper portion 206 of the swing frame 202 includes a left arm 224 connected to and extending upwardly from the left hub 216, and a right arm 226 connected to and extending upwardly from the right hub 218. Each of the arms 224, 226 may have a generally arcuate or C-shaped configuration. Components forming the swing frame 202 may be formed from tubular members, such as tubular stock metal.

Figure 8:
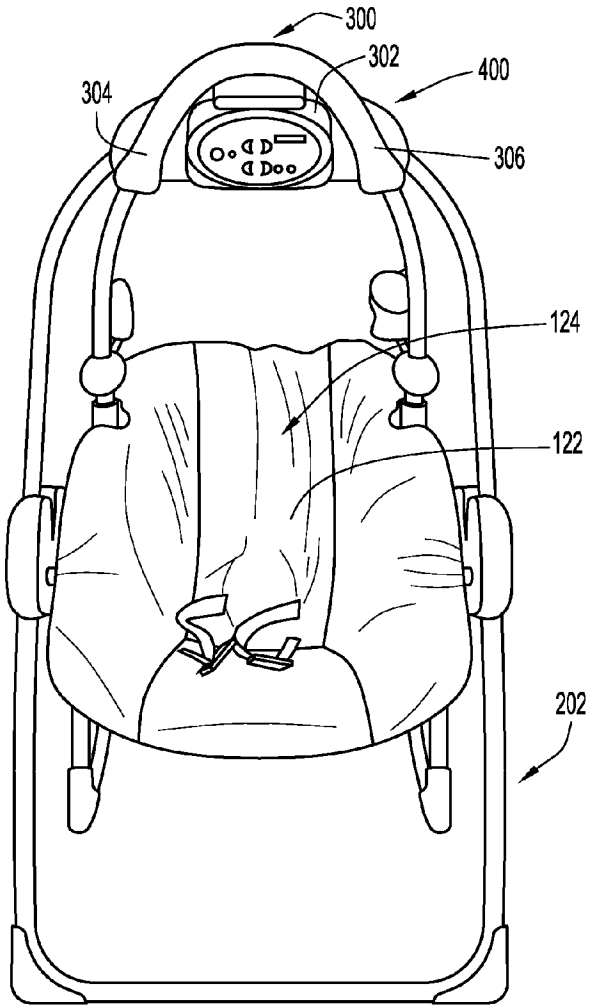
FIG. 8 illustrates another front perspective view of the apparatus of FIG. 1.

The swing support 200 includes a mounting portion 400. The mounting portion 400 is coupled distal ends of the left and right arms 224, 226. In one implementation, the mounting portion 400 is substantially centered over the receiving area 124 for the seat 122 when the infant rocker 100 is coupled to the swing support 200, as shown in FIG. 8. The engagement member 302 of the handle 300 is releasably coupleable to the mounting portion 400. As described above, the left and right side portions 304, 306 of the handle 300 and the seat 122 are rotatable about axis A1 and relative to the engagement member 302. Thus, the seat 122 is pivotal relative to the mounting portion 400 and the swing frame 202 when the engagement member 302 is coupled to the mounting portion 400. In this way, the seat 122 may swing back and forth within a rocker receiving area 228 (shown in FIGS. 6 and 7) defined by the swing support 200.

Figure 9:
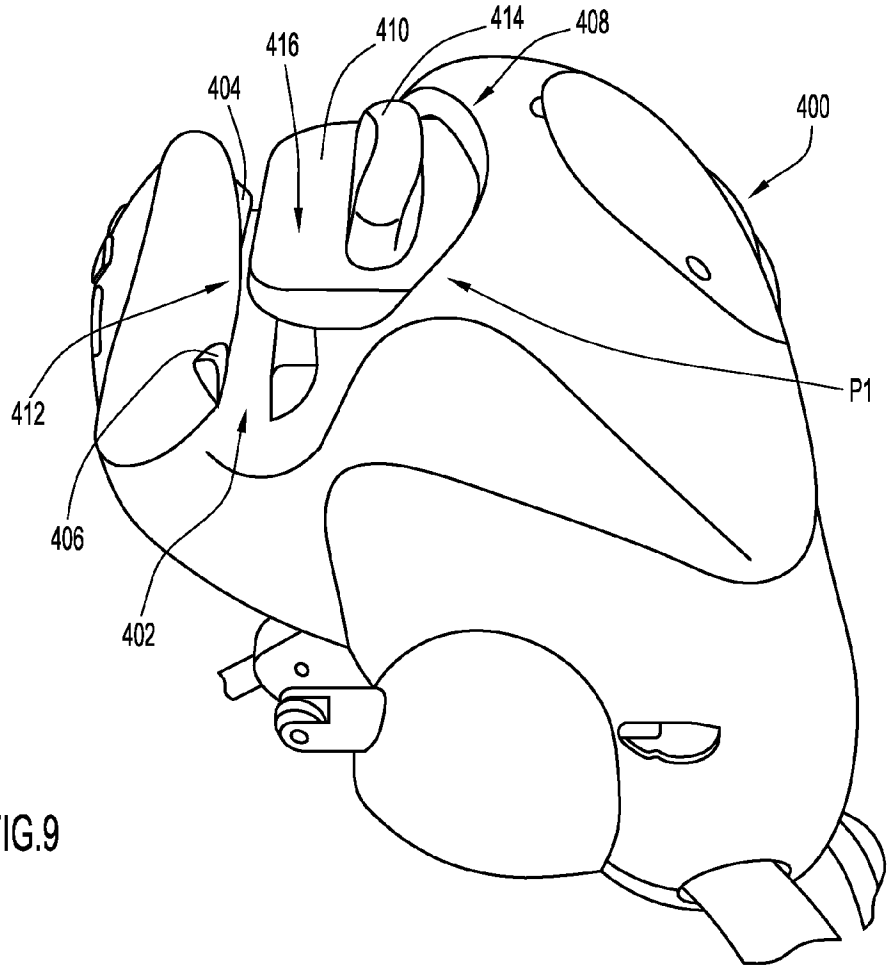
FIG. 9 illustrates a side perspective view of a mounting portion of the swing support of FIG. 3.

Referring to FIG. 9, the mounting portion 400 includes an elongate recess 402 configured to receive and retain the engagement member 302 of the handle 300. The recess 402 may include protrusions 404, 406 that engage and receive the indents 316, 318 provided in the engagement member 302 (shown in FIG. 5). Thus, the engagement member 302 may be securely seated within the recess 402. In one implementation, the corresponding configurations of the engagement member 302 and recess 402 restrict movement of the engagement member 302 when it is seated within the recess 402. However, the seat 122 is permitted to swing given the pivotal coupling between the engagement member 302 and the left and right side portions 304, 306 of the handle 300 (via the rod 310).

Figure 10:
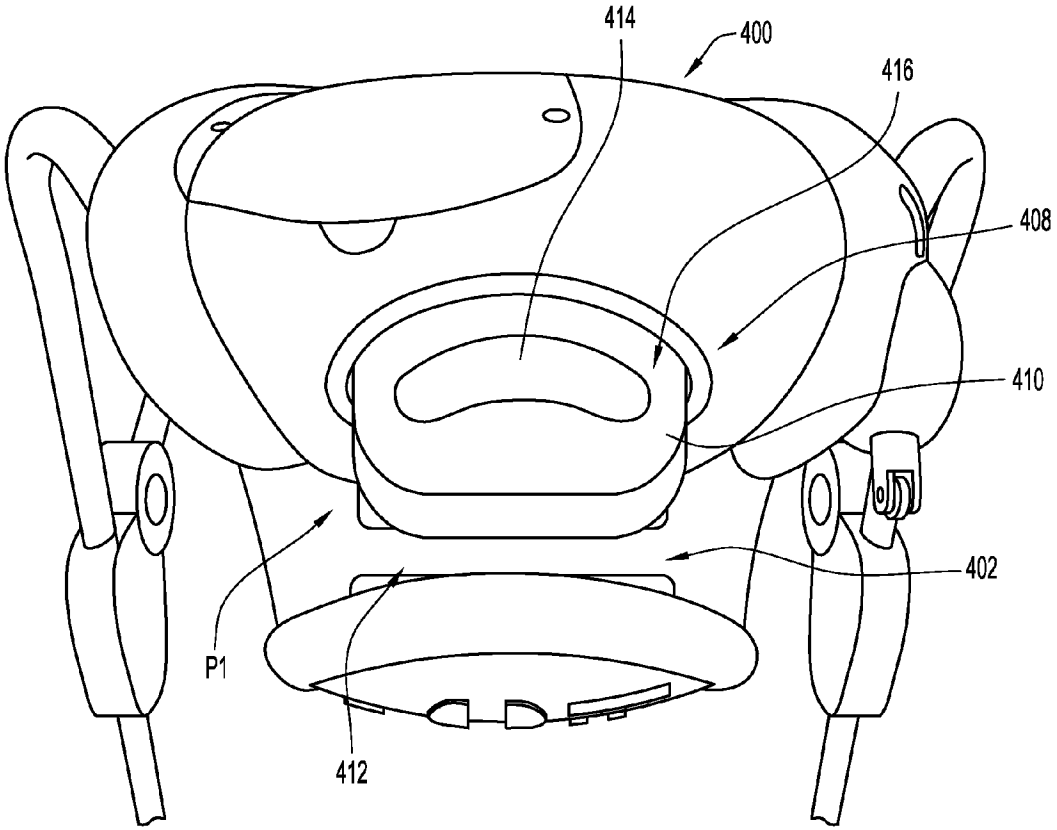
FIG. 10 illustrates a top perspective view of the mounting portion of the swing support of FIG. 3 and showing a locking mechanism in a locked position.
Figure 11:
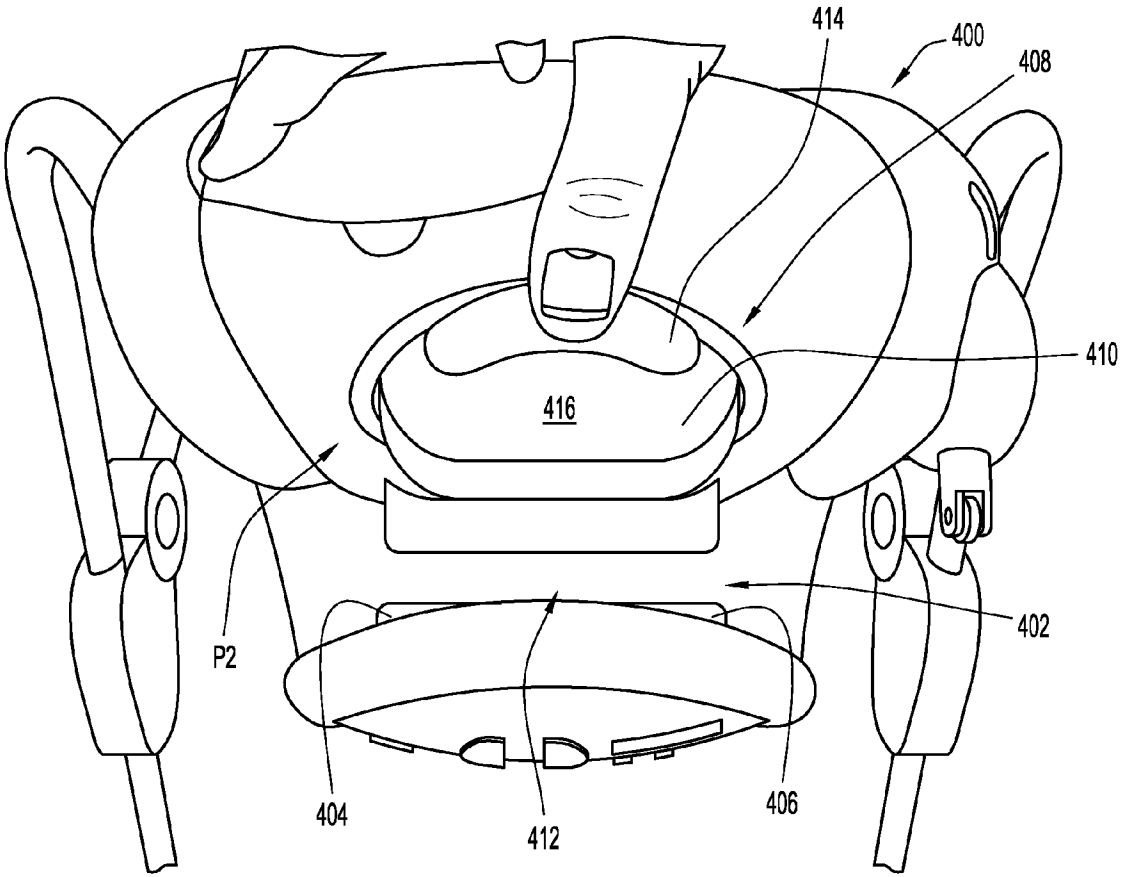
FIG. 11 illustrates another top perspective view of the mounting portion of the swing support of FIG. 3 and showing the locking mechanism in an unlocked position.
Figure 12:
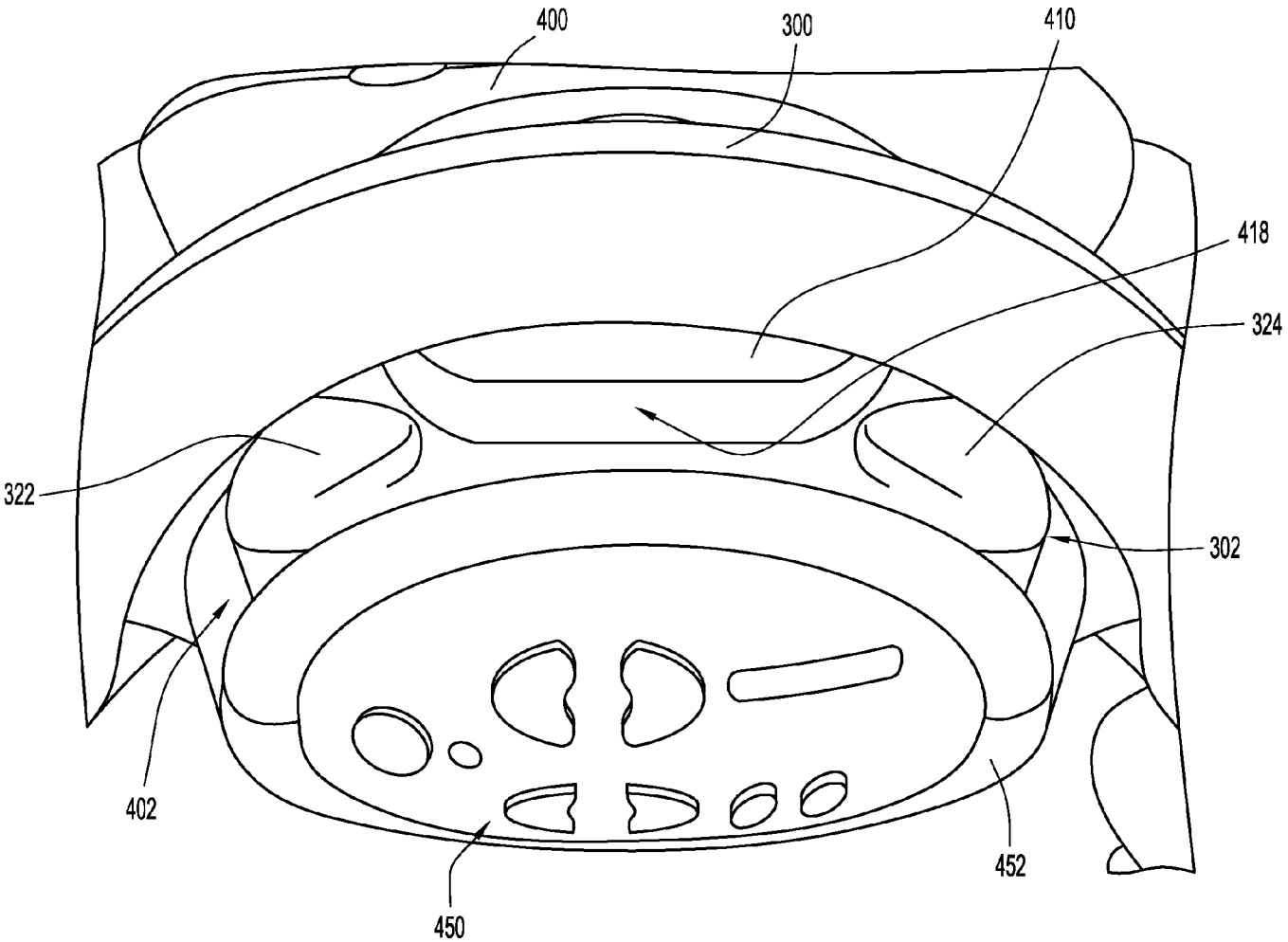
FIG. 12 illustrates a front perspective view of the mounting portion of FIG. 9 and showing an engagement member of a handle secured therein.

Referring to FIGS. 9, 10 and 11, in one embodiment the mounting portion 400 includes a locking mechanism 408 configured to releasably lock the engagement member 302 of the handle 300 within the recess 402 of the mounting portion 400. In one implementation, the locking mechanism 408 includes a lever or slide member 410 movable between a locked position P1 at least partially blocking an opening 412 of the recess 402 (shown in FIGS. 9 and 10), and an unlocked position P2 allowing or expanding access to the opening 412 of the recess 402 (shown in FIG. 11). In the unlocked position P2, the engagement member 302 may be inserted into or removed from the recess 402 through the opening 412. When the engagement member 302 is securely seated within the recess 402, the slide member 410 may be moved from its unlocked position P2 to its locked position P1, thereby releasably securing the engagement member 302 within the recess 402, as shown in FIG. 12.

The slide member 410 may be biased toward its locked position P1 (shown in FIGS. 9, 10 and 12) via a resilient member, such as a spring. The force of the resilient member may be overcome by a user sliding the slide member 410 away from the recess 402 and to its unlocked position (shown in FIG. 11). The slide member 410 may include a raised wall or release actuator 414 extending upwardly from an upper surface 416 of the slide member 410, which is engageable by the user for pulling or pushing the slide member 410 toward its unlocked position P2.

Thus, the slide member 410 may be hand operated, sliding rearward so that the handle 300 may be lifted off the mounting portion 400. When placing the handle 400 and engagement member 302 onto the mounting portion 400, the user simply drops the handle 300 into position, with the engagement member 302 aligned with the recess 402. The slide member 410 is pushed rearward due to the weight of the infant rocker 100, so that the engagement member 302 may be seated within the recess 402 of the mounting portion 400. The slide member 410 then returns to its locked position P1 via the resilient members to secure the engagement member 302 and thus handle 300 in place on the swing support 200. The seat 122 of the infant rocker 100 may then be utilized in a head-to-toe swinging mode of operation.

Referring again to FIG. 12, a front edge 418 of the slide member 410 is received between the raised end portions 322, 324 and against or adjacent the upper surface 326 of the body 308 of the engagement member 302. Thus, the engagement member 302 may be securely locked within the recess 402 via the slide member 410. The engagement member 302 may then be removed from the recess 402 by moving the slide member 410 to its unlocked position P2 (shown in FIG. 11), so that the infant rocker 100 may be decoupled from the swing support 200.

Figure 13:
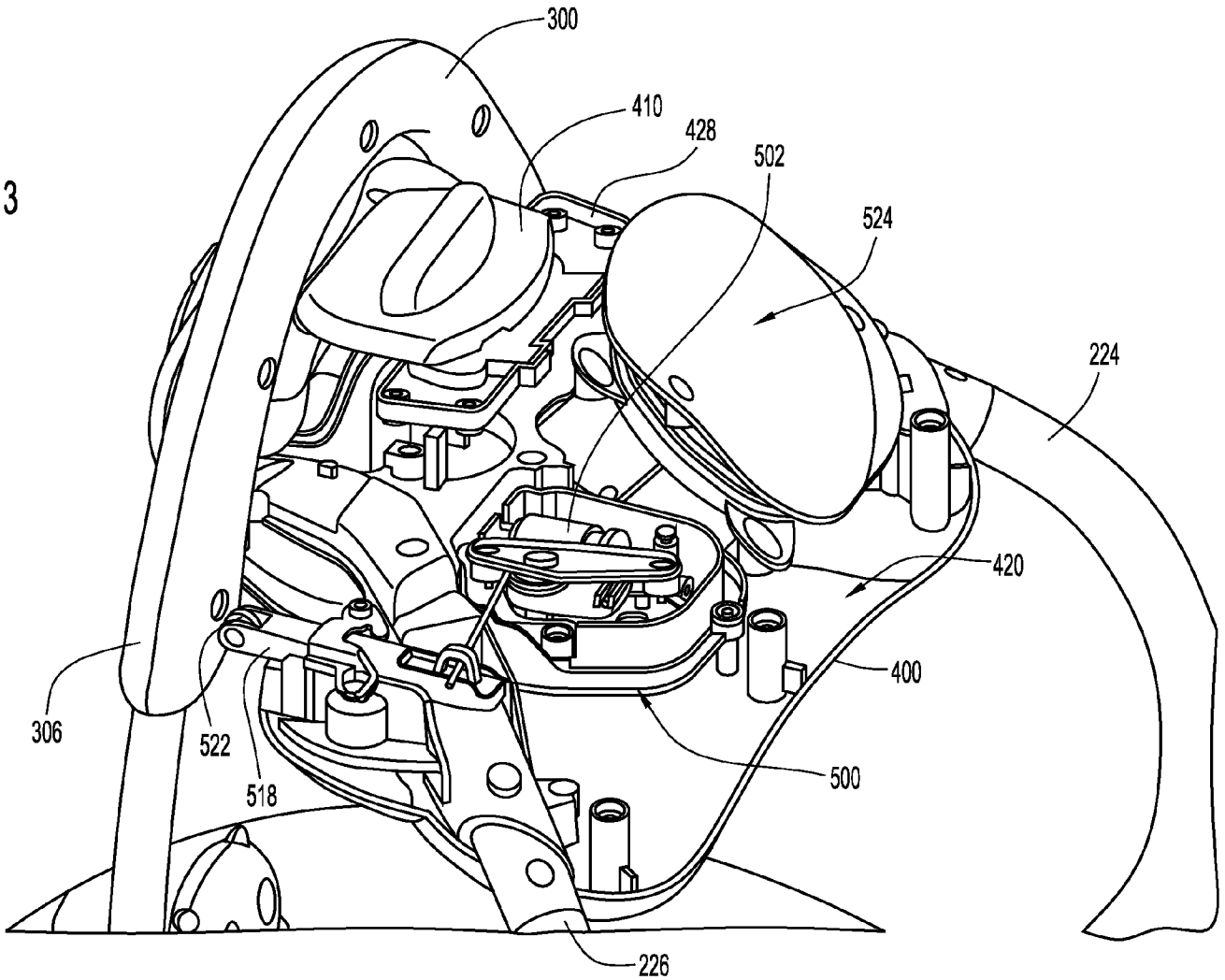
FIG. 13 illustrates a perspective view of internal components within the mounting portion of FIG. 9.
Figure 14:
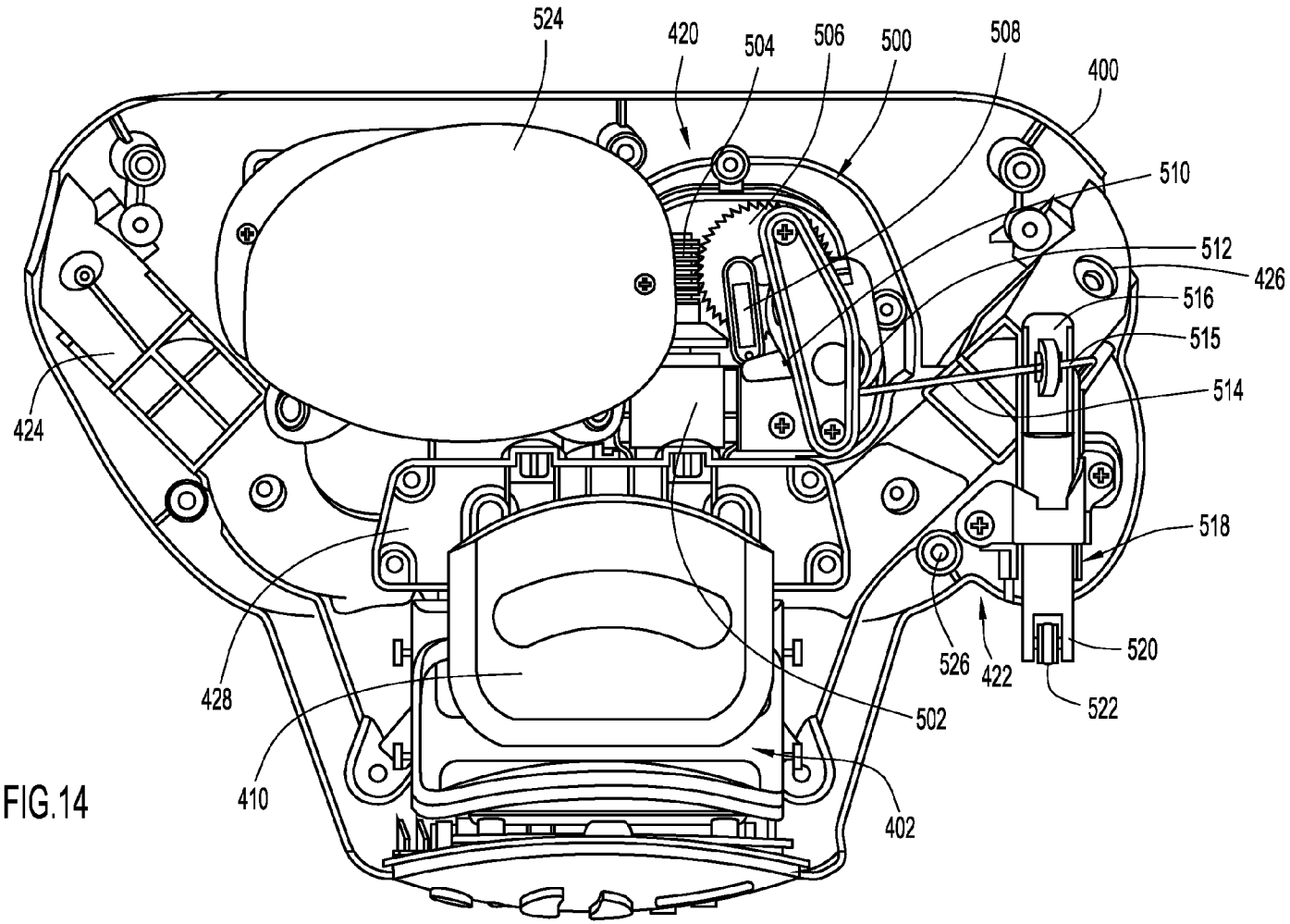
FIG. 14 illustrates a top view of the internal components shown in FIG. 13.

Referring to FIGS. 13 and 14, a drive mechanism 500 is coupled to the mounting portion 400. In one embodiment, the mounting portion 400 defines a cavity 420 in which the drive mechanism 500 is housed. The drive mechanism 500 may include a motor 502 that drives an associated gearing and linkage arrangement, such as a worm gear 504, drive gear 506, and offset and pivotally mounted linkage 508. Reciprocal motion of the linkage 508, via rotation of the drive gear 506, causes back and forth motion of another linkage 510. The linkage 510 may include or be coupled to a coil portion 512 and an outwardly extending portion 514. The coil portion 512 is pulled or pushed back and forth in opposite rotational directions as the linkage 508 is moved back and forth. As a result, the outwardly extending portion 514 of the linkage 510 is moved back and forth.

A distal end 515 of the outwardly extending portion 514 of the linkage 510 is coupled to an end portion 516 of a ram 518, which in turn is reciprocally moved back and forth as the distal end 515 of the extending portion 514 is moved. An opposing distal end portion 520 of the ram 518 is linearly moved toward and away from a front surface 422 of the mounting portion 400 upon actuation of the motor 502. In one implementation, the ram 518 is linearly movable along a direction which imparts a horizontal force component to a portion of the handle 300 relative to the supporting surface G. When the engagement member 302 of the infant rocker 100 is coupled to the mounting portion 400, the ram 518 engages a correspondingly aligned portion of the handle 300, as shown in FIG. 13, so that the seat 122 swings back and forth relative to the swing frame 202.

In one embodiment, the ram 518 is offset from the recess 402 of the mounting portion 400, and engageable with one of the left or right side portions 304, 306 of the handle 300. Thus, the ram 518 is linearly movable along an axis offset from a longitudinal axis of the seat 122 (when the infant rocker 100 is coupled to the swing support 200). The ram 518 may include a roller 522 coupled to the distal end 520 thereof and rotatable relative thereto. As the ram 518 pushes the corresponding side portion (e.g. side portion 306 as illustrated in FIG. 13) of the handle 300, the position of the ram 518 along the side portion 306 varies given the ram 518 is moving along a linear travel path, and the swinging side portion 306 of the handle 300 is moving along an arcuate travel path. Thus, the roller 522 minimizes any frictional forces generated by the displacement of the ram 518 upwardly or downwardly along the side portion 306.

With continued reference to FIGS. 13 and 14, the cavity 420 of the mounting portion 400 may also house a power source, such as a battery compartment 524, operably coupled to the motor 502. Further, the cavity 420 may include left and right receiving areas or sockets 424, 426 configured for receiving and retaining distal end portions of the left and right arms 224, 226 of the swing frame 202, respectively. The cavity 420 may also house a slide plate 428 to which the slide member 410 is movably coupled.

In one embodiment, a position detecting mechanism 526 is coupled to the mounting portion 400 and/or to the swing frame 202, and in communication with the drive mechanism 500. The position detecting mechanism 526 detects a position of the ram 518 relative to the mounting portion 400. In this way, the range of linear movement and/or frequency of reciprocal motion of the ram 518 may be monitored and/or controlled. Thus, the resulting swinging motion of the seat 122 may be controlled.

Referring again to FIG. 12, the mounting portion 400 includes a control panel 450 disposed on a front face 452 thereof. Actuation of the motor 502, and thus initiation or stopping of the swinging motion, may be controlled and/or adjusted via the control buttons provided on the control panel 450. In one embodiment, the control panel 450 includes a plurality of control buttons thereon for controlling movement of the swing. For example, power to the motor may be controlled by depressing the on/off button on the control panel. Actuation of the motor and thus reciprocal movement of the ram may be commenced or stopped by depressing a motion control button. The speed of reciprocal motion of the ram, and thus the speed and range of motion of the swinging of the seat, may be further controlled by depressing a speed control button and/or via the up/down (e.g. +/−) buttons. Further, the support structure may include audio output, such as songs, music and/or sound effects, via one or more associated speakers (not shown). The control panel includes an on/off button and a volume adjust button for controlling the audio output.

The specific configuration of the control panel 450 may vary depending on the functionality and level of control of the support structure. Further, it should be understood that the specific configuration of other components of the combination rocker and swing S1 may vary. For example, the specific configuration of the handle and engagement member, and corresponding coupling area on the mounting portion, may vary.

Figure 15:
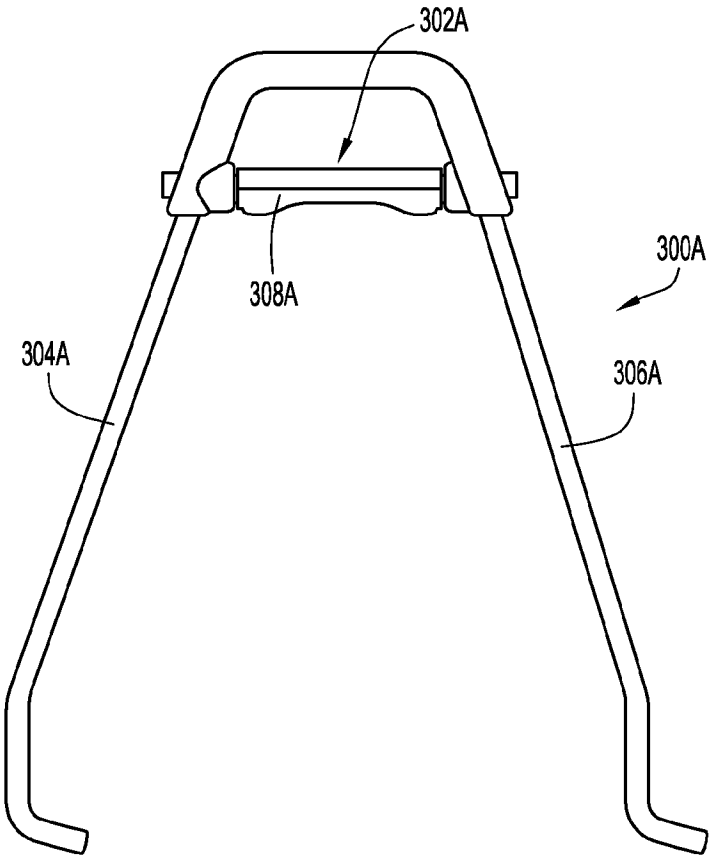
FIG. 15 illustrates a perspective view of a handle according to another embodiment of the present invention.

Referring to FIG. 15, a handle 300A according to another embodiment of the present invention is illustrated. The handle 300A is coupled to a seat assembly and extends upwardly from the receiving area of the seat assembly, as described above.

The handle 300A is similar to handle 300, and includes an engagement member 302A, a left side portion 304A, and a right side portion 306A. The left side portion 304A of the handle extends between and interconnects a left side portion of a seat assembly and the engagement member 302A. The right side portion 306A extends between and interconnects a right side portion of a seat assembly and the engagement member 302A.

Figure 16:
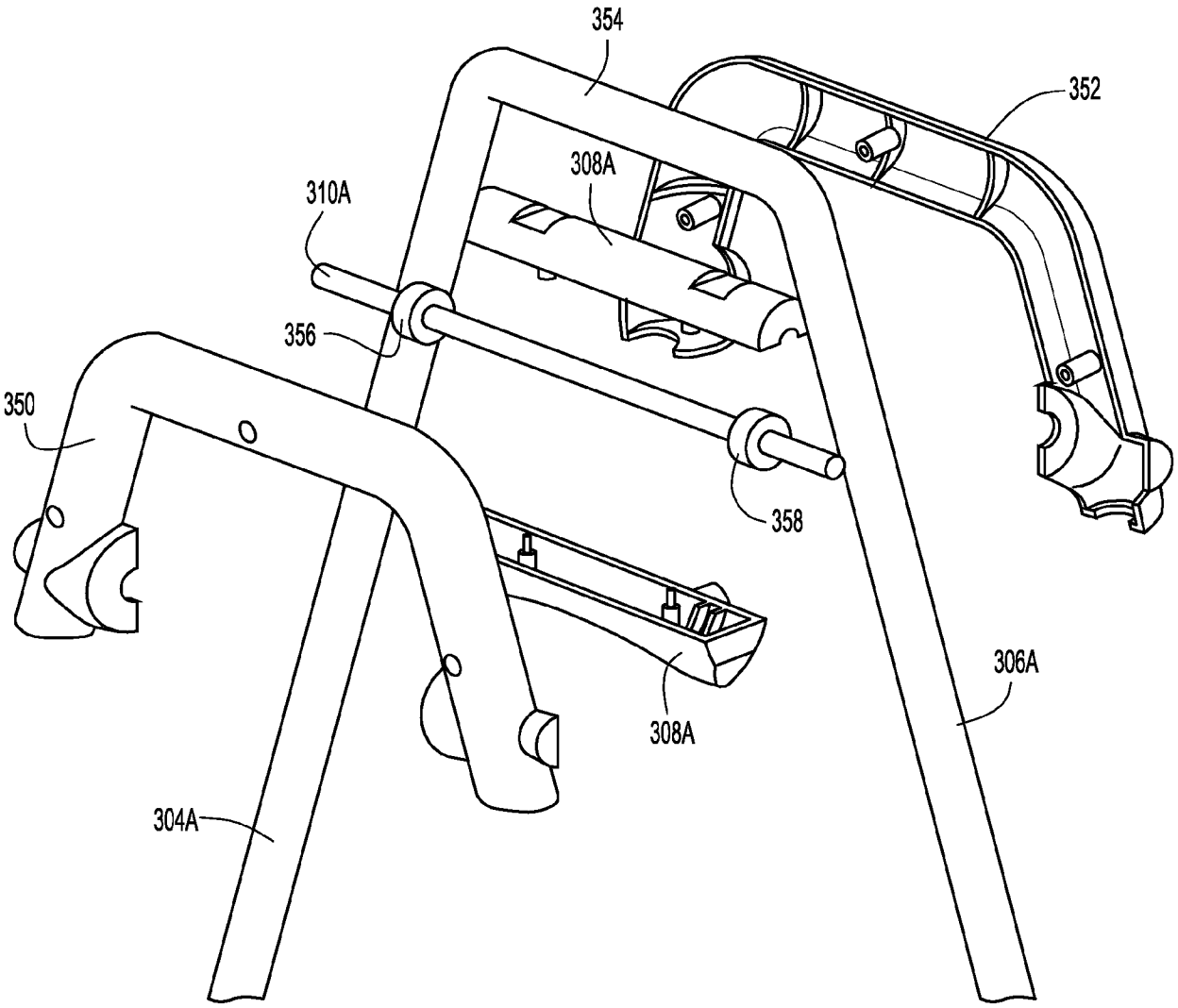
FIG. 16 illustrates a perspective assembly view of components of the handle of FIG. 15.

Further, the engagement member 302A has an elongated body extending between the left side portion 304A and the right side portion 306A of the handle 300A. Referring to FIG. 16, a rod 310A extends through a body portion 308A (shown in halves in FIG. 16) of the engagement member 302A. Opposing ends of the rod 310A are connected to and sandwiched between opposing cover sections 350, 352, which also clamp around a top portion 354 of the handle 300A, as shown in FIG. 15. The body 308A is rotatably disposed on the rod 310A. Bearings 356, 358 are coupled to the rod 310A, and reduce friction between the rod 310A and the body 308A while it is pivoting.

Figure 17:
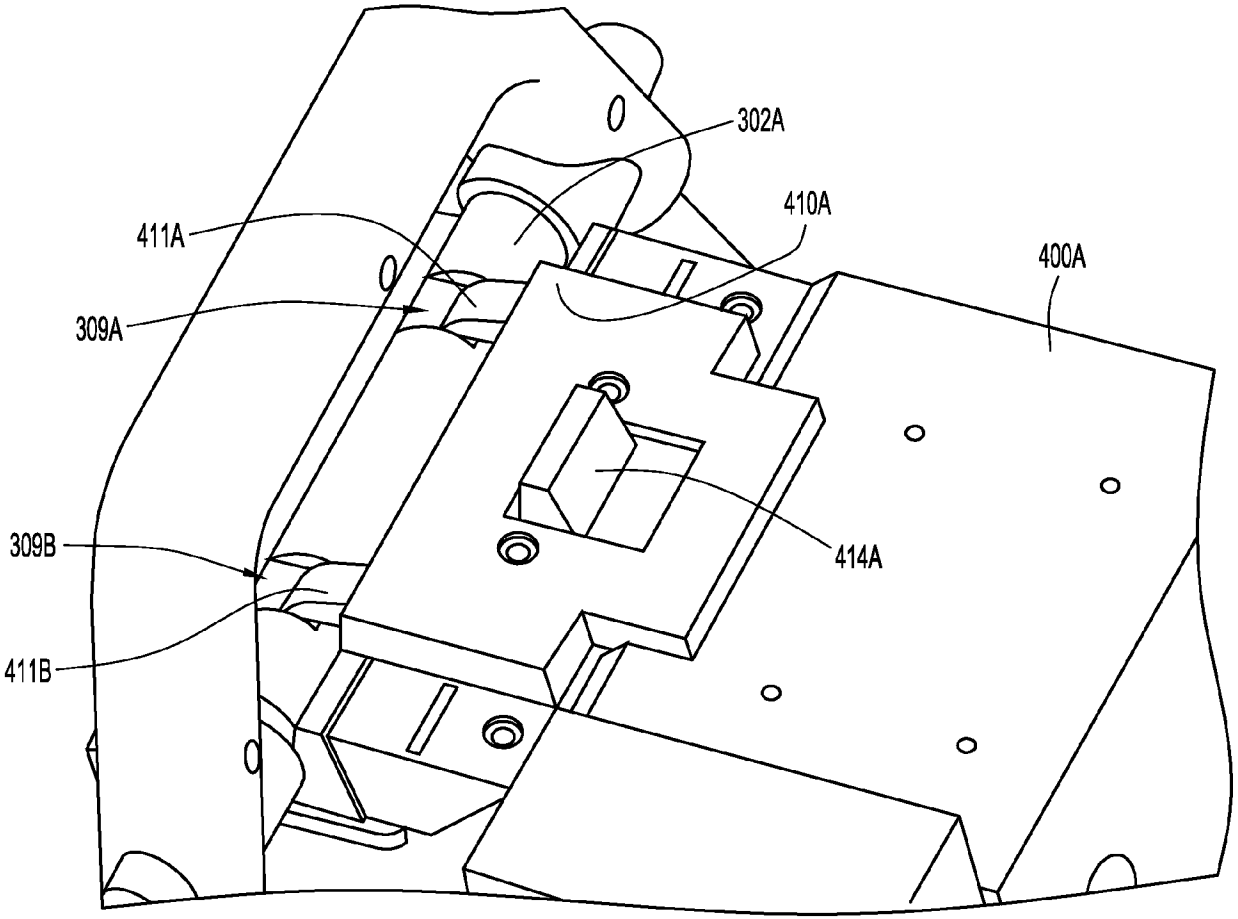
FIG. 17 illustrates a top perspective view of portions of the handle of FIG. 15 and portions of a mounting portion according to another embodiment of the present invention.

Referring to FIG. 17, the engagement bar 302A is receivable in a correspondingly configured recess disposed in a mounting portion 400A (as described above). The mounting portion 400A may include a locking mechanism, such as a slide member 410A which engages a portion of the body 308A of the engagement member 302A. In one implementation, the slide member 410A includes spaced teeth 411A, 411B that slide into correspondingly configured slots 309A, 309B provided on an upper surface of the body 308A. An actuator 414A is coupled to the slide member 410A for pulling the teeth 411A, 411B away from the engagement member 302A, thereby allowing the engagement member 302A to be decoupled from the mounting potion 400A.

Figure 18:
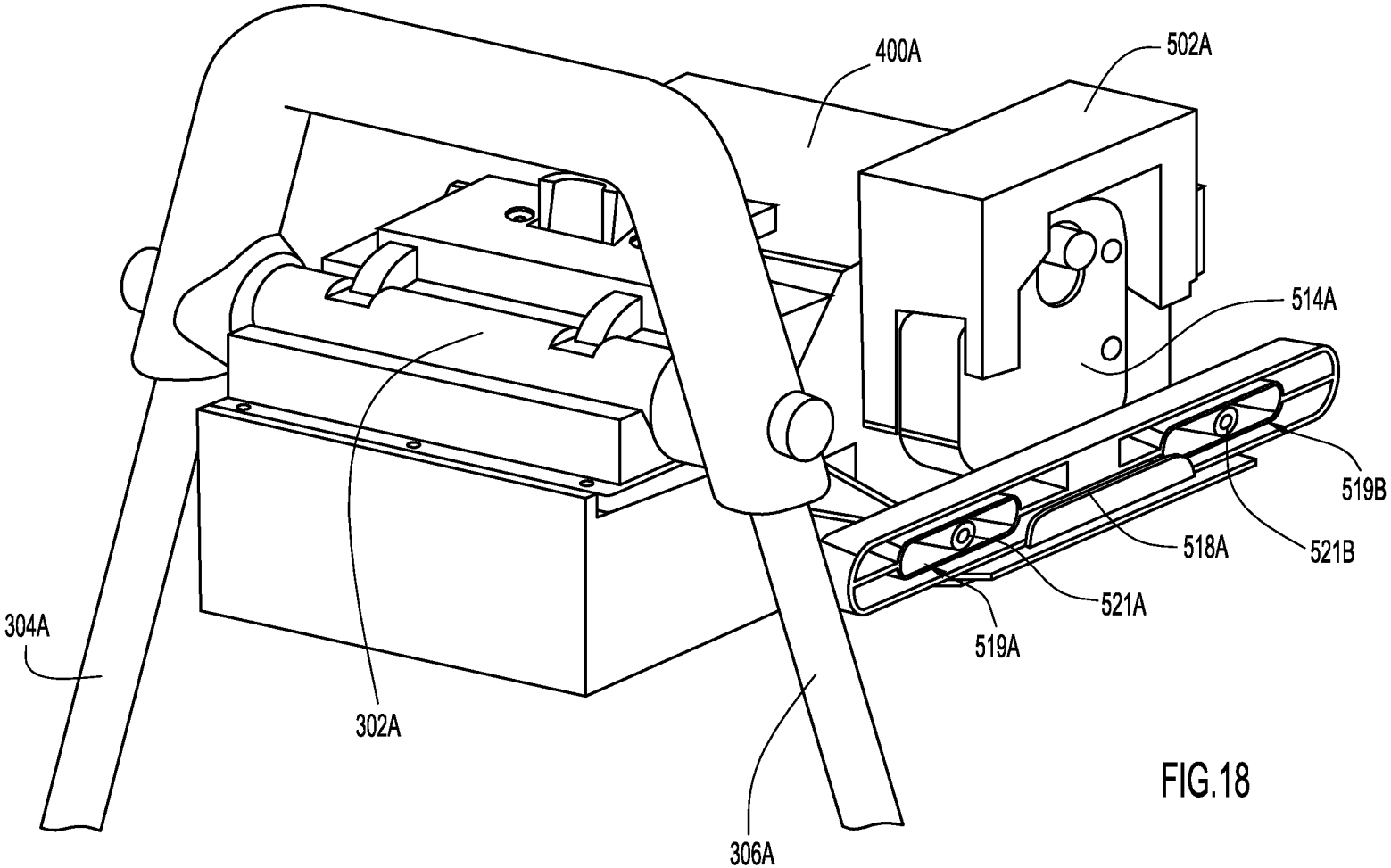
FIG. 18 illustrates a side perspective view of portions of the handle and of the mounting portion of FIG. 17.

Referring to FIG. 18, a ram 518A is movable coupled to the mounting portion 400A. The ram 518A is linearly and reciprocally movable toward and away from the mounting portion 400A, as described above. However, the coupling between the ram 518A and the drive mechanism, such as a motor 502A, may be arranged differently than described above. For example, the motor 502A may be coupled to a drive member 514A which reciprocates back and forth via actuation of the motor 502A. The ram 518A includes slots 519A, 519B. Receiving arms 521A, 521B are slidably received in the slots 519A, 519B, respectively, so that the ram 518A linearly moves back and forth upon actuation of the motor 502A and movement of the drive member 514A. The drive member 514A is coupled to a central portion the ram 518A (via any suitable mechanical connection), and causes the ram 518A to reciprocate back and forth as the receiving arms 521A, 521B slide back and forth between opposing ends of the corresponding slots 519A, 519B.

Thus, various alternative arrangements may be employed for reciprocally driving the ram. Further, various alternative configurations of the various components of the mounting portion, handle and engagement portion may be employed.

Figure 19:
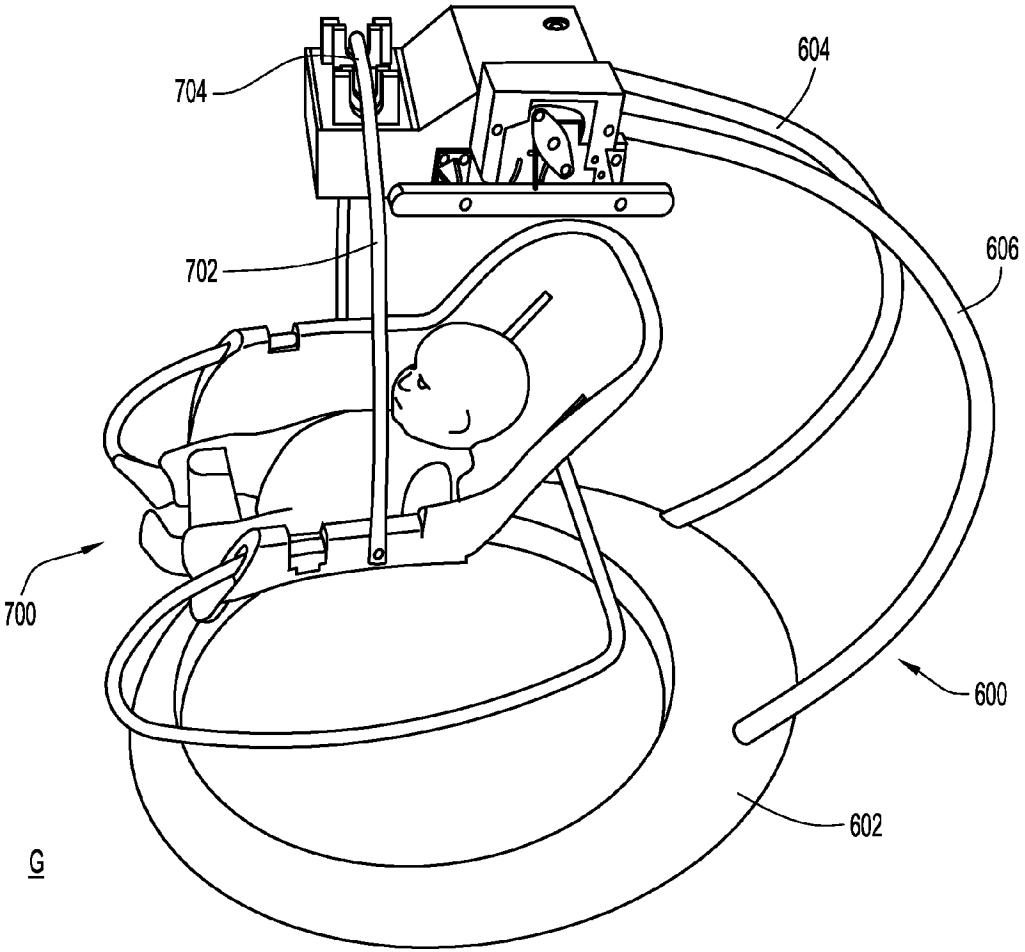
FIG. 19 illustrates a side perspective view of a swing support and a seat assembly according to another embodiment of the present invention.

Similarly, the specific configuration of the seat assembly and swing frame may vary. For example, alternative configurations of a seat assembly and swing frame are illustrated in FIG. 19. As depicted therein, the swing frame 600 includes a generally round base member 602 configured for engaging the supporting surface G, and first and second arcuate arms 604, 606 extending upwardly therefrom and coupled to the mounting portion (e.g. mounting portion 400 or mounting portion 400A). The seat assembly 700 includes a handle 702 having a generally U-shaped configuration, with a top portion 704 of the handle 702 functioning as an engagement member.

Thus, although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A combination infant rocker and swing, comprising:

an infant rocker including a frame having a curved lower portion and an upper portion, a seat portion coupled to the upper portion, and a handle portion extending upwardly from the seat portion; and a swing support including:

a swing frame including a lower portion configured for engaging a supporting surface and an upper portion, a mounting portion coupled to the upper portion of the swing frame, the handle releasably and pivotally coupleable to the mounting portion, and a drive mechanism coupled to the mounting portion, the drive mechanism including a ram reciprocally movable and engageable with the handle, thereby pivoting the handle within the mounting portion so that the seat portion swings back and forth relative to the swing frame.

2. The combination infant rocker and swing of claim 1, wherein the mounting portion includes a locking mechanism configured to releasably lock the handle to the mounting portion.

3. The combination infant rocker and swing of claim 2, wherein the locking mechanism includes a lever and a release actuator configured to move the lever between a locked position and an unlocked position.

4. The combination infant rocker and swing of claim 1, wherein the handle includes an engagement bar receivable in a correspondingly configured recess disposed in the mounting portion.

5. The combination infant rocker and swing of claim 4, wherein the engagement bar includes a rod with bearings coupled thereto, the rod defining a rotational axis about which the seat portion swings.

6. The combination infant rocker and swing of claim 1, wherein the handle includes an engagement portion receivable in a correspondingly configured recess disposed in the mounting portion, and a side portion extending between the engagement portion and the seat portion.

7. The combination infant rocker and swing of claim 6, wherein the ram is offset from the recess of the mounting portion, and engageable with the side portion of the handle.

8. The combination infant rocker and swing of claim 1, wherein the ram is linearly movable along a direction which imparts a horizontal force component to a portion of the handle relative to the supporting surface.

9. An infant support structure, comprising:

a seat assembly including a receiving area configured for supporting an infant therein;

a handle coupled to the seat assembly and extending upwardly from the receiving area, the handle including an engagement member;

a support frame including a lower portion configured for engaging a supporting surface and an upper portion;

a mounting portion coupled to the upper portion of the frame, the engagement member of the handle being removably and pivotally coupleable within the mounting portion;

a drive mechanism coupled to the mounting portion, the drive mechanism including a drive member reciprocally movable relative to the mounting portion, the drive member engageable with the handle to pivot the handle within the mounting portion so that the seat assembly swings back and forth relative to the support frame.

10. The infant support structure of claim 9, wherein the seat assembly includes a frame having a curved lower portion configured for rocking back and forth on the supporting surface when the seat assembly is decoupled from the mounting portion.

11. The infant support structure of claim 9, wherein the handle includes a side portion extending between the engagement member and a side portion of the seat assembly.

12. The infant support structure of claim 9, wherein the engagement member includes at least one bearing receivable in a correspondingly configured recess disposed in the mounting portion.

13. The infant support structure of claim 9, wherein the mounting portion includes a recess configured to receive the engagement member.

14. The infant support structure of claim 13, wherein the mounting portion includes a slide member movable between a first position blocking an opening of the recess so that the engagement member is secured therein, and a second position allowing access to the opening of the recess so that the engagement member may be removed from therefrom.

15. The infant support structure of claim 9, wherein the receiving area has a longitudinal axis, the ram linearly movable along an axis offset from the longitudinal axis of the receiving area.

16. The infant support structure of claim 9, wherein the drive mechanism includes a position detecting mechanism configured to detect a position of the drive member relative to the mounting portion.

17. The infant support structure of claim 9, wherein the drive member is linearly movable along a direction which imparts a horizontal force component to a portion of the handle relative to the supporting surface.

18. A drive mechanism for a swing, comprising:

a mounting portion including a recess that releasably receives a first portion of a handle of a seat assembly;

a drive member reciprocally movable relative to the mounting portion and offset from the recess, the drive member engaging a second portion of the handle of the seat assembly.

19. The drive mechanism of claim 18, further comprising a slide member coupled to the mounting portion and movable between a first position blocking an opening of the recess and a second position allowing access to the opening of the recess.

20. The drive mechanism of claim 18, wherein the mounting portion includes engagement sockets configured for receiving correspondingly configured portions of a support frame for the swing, the mounting portion substantially centered over a receiving area for the swing when coupled to the support frame.

* * * * *